US008429934B2

(12) United States Patent
Roessler

(10) Patent No.: US 8,429,934 B2
(45) Date of Patent: Apr. 30, 2013

(54) JEWELRY AND METHOD FOR ITS USE

(76) Inventor: Joanne Roessler, San Rafael, CA (US)

( * ) Notice: Subject to any disclaimer, the term of this patent is extended or adjusted under 35 U.S.C. 154(b) by 296 days.

(21) Appl. No.: 12/944,414

(22) Filed: Nov. 11, 2010

(65) Prior Publication Data

US 2011/0146345 A1 Jun. 23, 2011

Related U.S. Application Data

(60) Provisional application No. 61/287,232, filed on Dec. 17, 2009.

(51) Int. Cl.
*A44C 9/00* (2006.01)

(52) U.S. Cl.
USPC ..... 63/15; D11/26

(58) Field of Classification Search ..... None
See application file for complete search history.

(56) References Cited

U.S. PATENT DOCUMENTS

| | | | | |
|---|---|---|---|---|
| D67,909 | S * | 7/1925 | Staub | D11/2 |
| 1,691,445 | A | 6/1927 | Meliodon | |
| D109,800 | S | 3/1938 | Foss | |
| D193,404 | S | 8/1962 | Telford | |
| D212,966 | S | 12/1968 | Pence | |
| 4,028,908 | A | 6/1977 | Michael | |
| D310,498 | S | 9/1990 | Mejias | |
| 5,755,116 | A | 5/1998 | Sparacino et al. | |
| 5,987,919 | A | 11/1999 | Hooser | |
| 6,484,536 | B1 | 11/2002 | Gould | |
| 6,581,413 | B1 | 6/2003 | Kadosh | |
| 7,222,503 | B2 | 5/2007 | Golove | |

OTHER PUBLICATIONS

VII. ABEE, http://www.armorjewelry.com/shop/abee/, date unknown.

Peace Symbol Charm Ring, http://westcoastjewelry.com/Peace-Symbol-Charm-Ring/M/B000W937B8.htm, date unknown.

Jessica Elliot Skinny Charm Rings, http://www.zappos.com/jessica-elliot-skinny-charm-rings, date unknown.

14K Diamond-Accented Flower Dangle Ring, http://jewelry.hsn.com/14k-diamond-accented-flower-dangle-ring_p-4006763_xp.aspx, date unknown.

Dangle Ring Builder, http://secure.jamesavery.com/view_jewelry/dangle-ring-builder/, date unknown.

Laura Alexander Love and Light Citrine Ring, http://www.maxandchloe.com/fulldetails/9435, date unknown.

Irish Charm Rings, http://stores.homestead.com/theirishjewelry company/-strse-229/shamrock-shamrocks-3-leaf/Detail.bok, date unknown.

14kt Gold Fingernail with chain and ring, http://everythingbling.ecrater.com/p/6168173/14ktnail-03-14kt-gold-fingernail-with-chain-and, date unknown.

* cited by examiner

*Primary Examiner* — Jack W. Lavinder
(74) *Attorney, Agent, or Firm* — Buchanan Nipper

(57) ABSTRACT

A jewelry piece comprising a ring shank, at least one first connector, at least one second connector, at least one first linkage, at least one second linkage, and at least one charm.

20 Claims, 7 Drawing Sheets

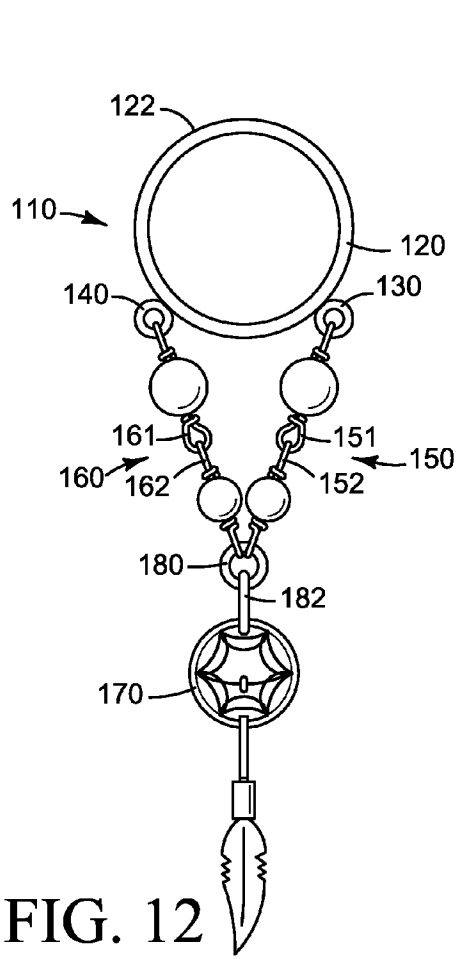
FIG. 12
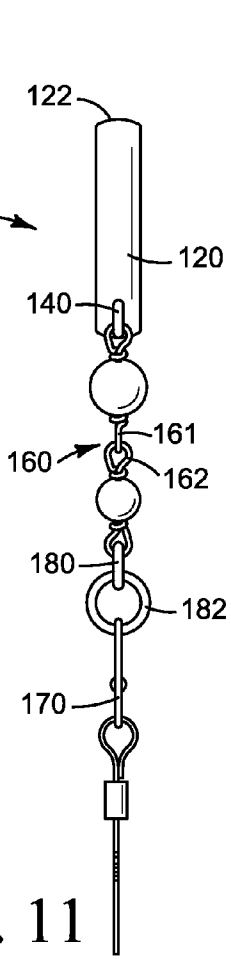
FIG. 11
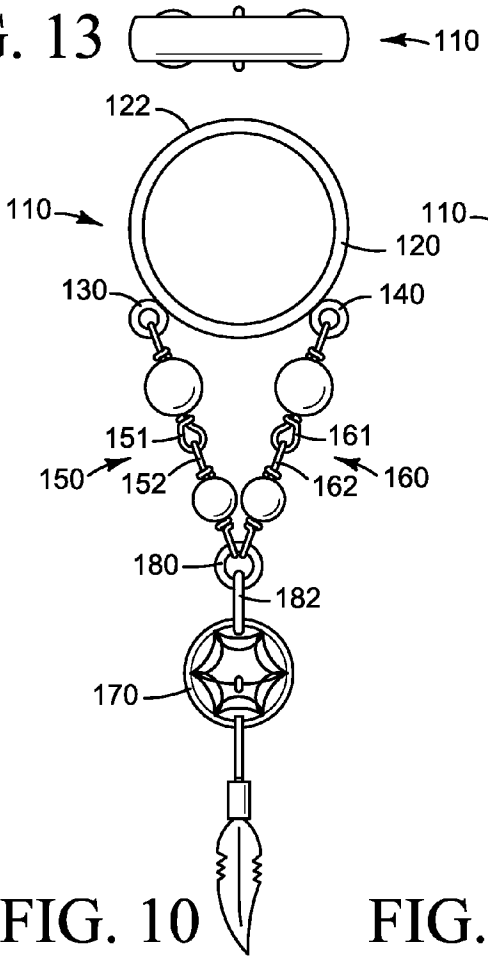
FIG. 10
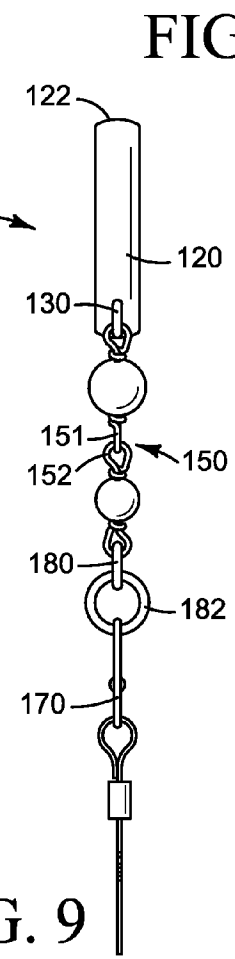
FIG. 9
FIG. 13
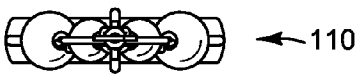
FIG. 14

JEWELRY AND METHOD FOR ITS USE

PRIORITY/CROSS-REFERENCE TO RELATED APPLICATIONS

This application claims the benefit of U.S. Provisional Application No. 61/287,232, filed Dec. 17, 2009, the disclosure of which is incorporated by reference.

TECHNICAL FIELD

The disclosure generally relates to the field of jewelry. Particular embodiments relate to rings worn on a wearer's finger(s).

SUMMARY OF THE DISCLOSURE

A jewelry piece comprising a ring shank, at least one first connector, at least one second connector, at least one first linkage, at least one second linkage, and at least one charm.

The purpose of the Abstract is to enable the public, and especially the scientists, engineers, and practitioners in the art who are not familiar with patent or legal terms or phraseology, to determine quickly from a cursory inspection, the nature and essence of the technical disclosure of the application. The Abstract is neither intended to define the inventive concept(s) of the application, which is measured by the claims, nor is it intended to be limiting as to the scope of the inventive concept(s) in any way.

Other features and advantages of the presently disclosed and claimed inventive concept(s) will become readily apparent to those skilled in the art from the following detailed description describing preferred embodiments of the inventive concept(s) by way of illustration of the best mode contemplated for carrying out the inventive concept(s). As will be realized, the inventive concept(s) is capable of modification in various obvious respects all without departing from the inventive concept(s). Accordingly, the drawings and description of the preferred embodiments are to be regarded as illustrative in nature, and not as restrictive in nature.

BRIEF DESCRIPTION OF THE DRAWINGS

FIG. 9 is a first side view of the embodiment of FIG. 2.

FIG. 10 is a front side view of the embodiment of FIG. 2.

FIG. 11 is a second side view of the embodiment of FIG. 2.

FIG. 12 is a rear side view of the embodiment of FIG. 2.

FIG. 13 is a top side view of the embodiment of FIG. 2.

FIG. 14 is a bottom side view of the embodiment of FIG. 2.

DETAILED DESCRIPTION OF THE EXEMPLARY EMBODIMENTS

Figure 1:
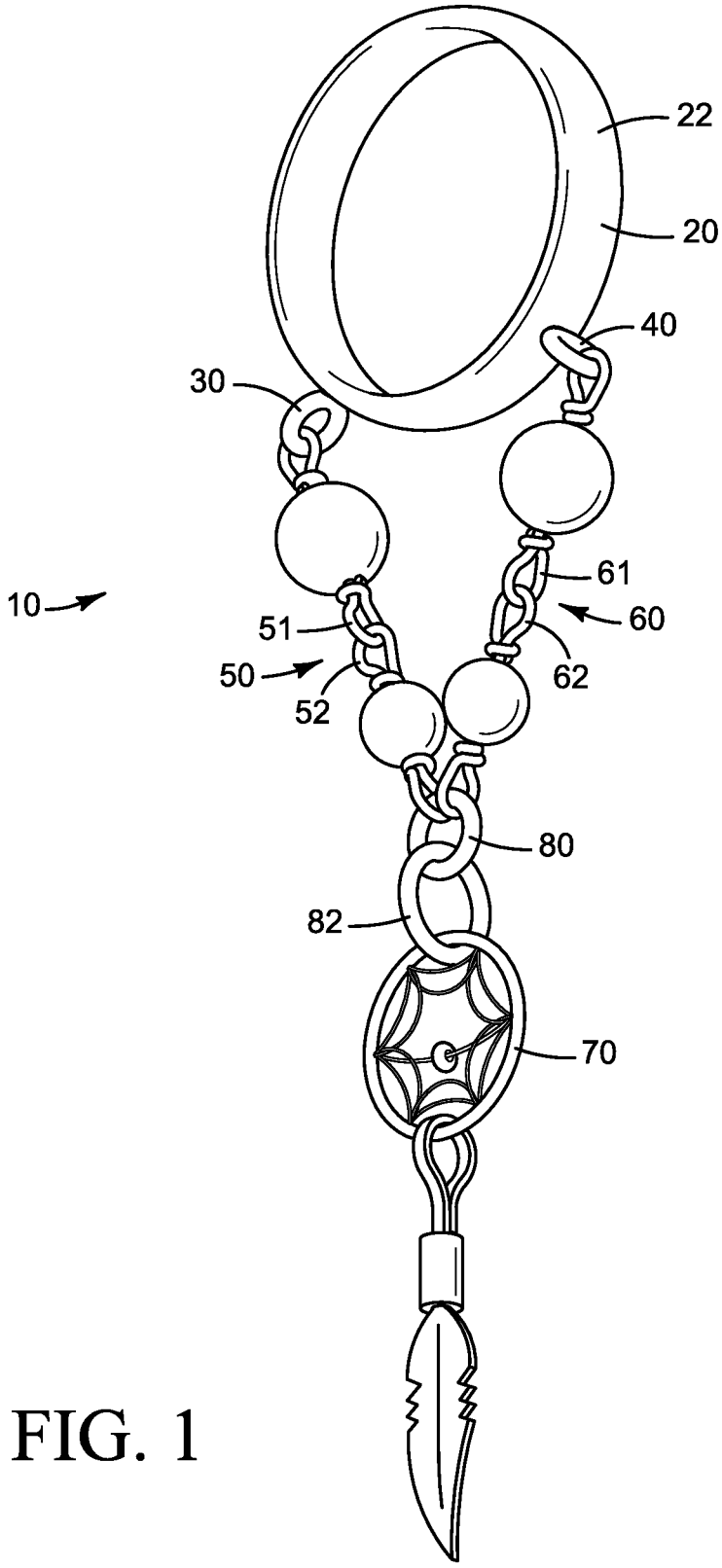
FIG. 1 is a perspective view a first embodiment of the inventive concept(s).

While the presently disclosed inventive concept(s) is susceptible of various modifications and alternative constructions, certain illustrated embodiments thereof have been shown in the drawings and will be described below in detail. It should be understood, however, that there is no intention to limit the inventive concept(s) to the specific forms disclosed. On the contrary, the presently disclosed and claimed inventive concept(s) is to cover all modifications, alternative constructions, and equivalents falling within the spirit and scope of the inventive concept(s) as defined in the claims.

In the following description and in the Figures, like elements are identified with like reference numerals.

The use of "e.g.," "etc," and "or" indicates non-exclusive alternatives without limitation unless otherwise noted.

The use of "including" means "including, but not limited to," unless otherwise noted.

A first embodiment of the inventive concept(s) is illustrated in FIGS. 1 through 7. FIG. 1 illustrates a jewelry piece 10 comprising a ring shank 20, a first connector 30, a second connector 40, a first linkage 50, a second linkage 60, and a charm 70.

The ring shank 20 is the part of the jewelry piece 10 that fits around a wearer's finger. Preferably, the ring shank 20 is circular in shape, having a circumference defined from a center point that defines a ring plane. The ring shank can be non-circular in shape, and may be open (being an arc) instead of closed (a circle). The use of the term "ring shank" is intended to include one or more ring shanks.

The ring shank 20 has a shank width defined as the width of the shank. The ring shank 20 also has a shank thickness defined as the distance between the shank's outer surface 22 and the shank's inner surface. The inner surface is configured to be adjacent a wearer's finger when the jewelry piece 10 is disposed around the wearer's finger. In an alternative embodiment, the ring shank 20 could include a head setting (not shown) for receiving a gemstone.

Figures 2, 3, 4, 5, 6, 7:
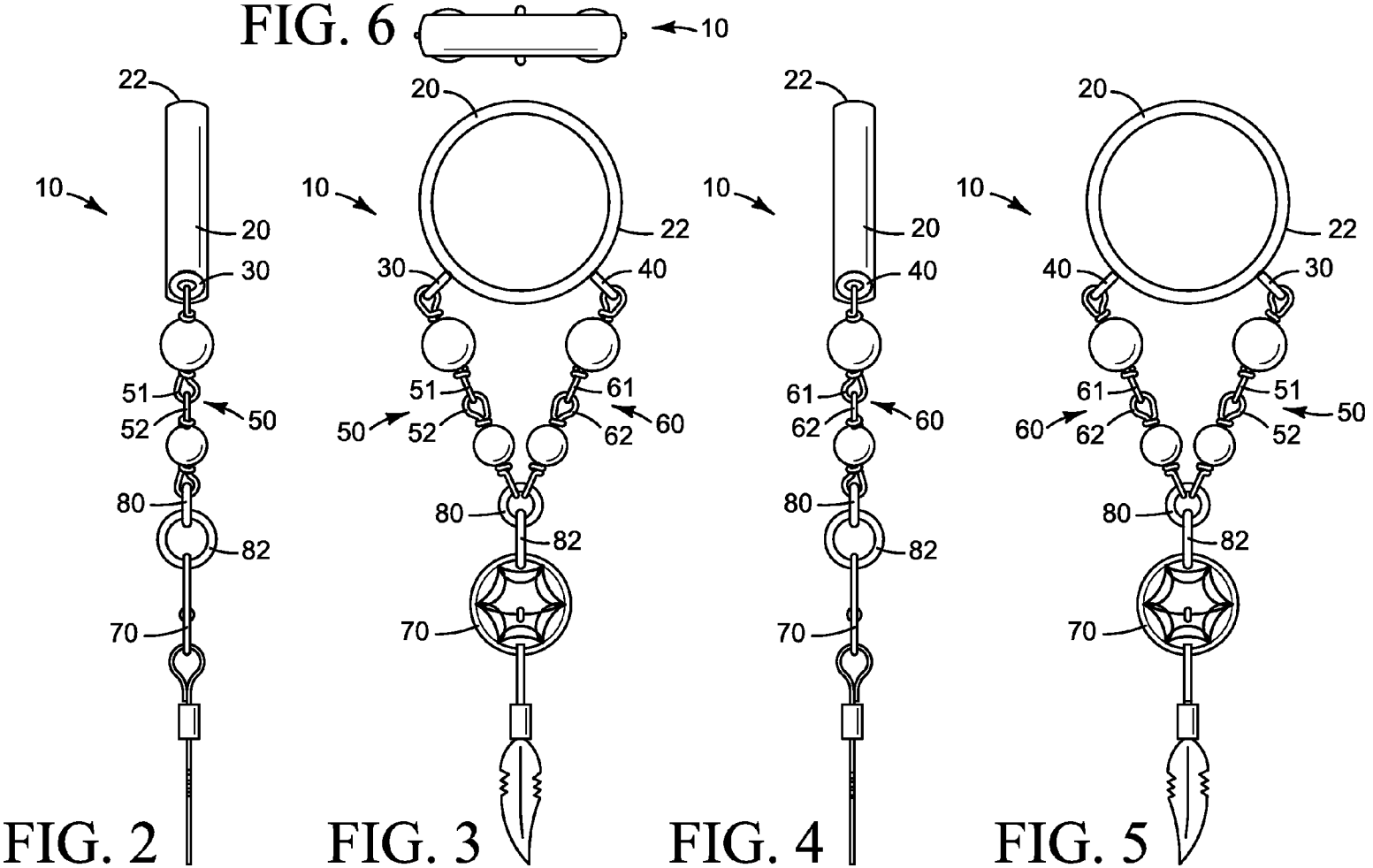
FIG. 2 is a first side view of the embodiment of FIG. 1.
FIG. 3 is a front side view of the embodiment of FIG. 1.
FIG. 4 is a second side view of the embodiment of FIG. 1.
FIG. 5 is a rear side view of the embodiment of FIG. 1.
FIG. 6 is a top side view of the embodiment of FIG. 1.
FIG. 7 is a bottom side view of the embodiment of FIG. 1.

The first connector 30 and the second connector 40 are oriented on the outer surface 22 of the ring shank 20 in a plane generally perpendicular to the ring plane, as shown in FIGS. 3 and 5. Preferably, the outer surface 22 has a radially outward surface, and the first connector 30 and the second connector 40 are oriented on the radially outward surface of the outer surface 22. A finger ring, having a torus shape, has a radially outward surface and a radially inward surface which meet at a ring top and a ring bottom. Other orientations are envisioned, including any angle between the generally perpendicular plane of the first embodiment and the parallel plane shown in the second embodiment (infra).

The first and second connectors are shown physically connected to the outer surface 22 via soldering. Other manners of making the connection are also possible, including but not limited to welding and adhesives. Further, the connectors could be formed as parts of the ring itself, or could extend around the ring shank 20.

Attached to the first connector 30 is a first linkage 50. In the first illustrated embodiment, the first linkage 50 comprises a pair of interconnected links (51, 52), each link having a small bead or other decorative element. Likewise, the second linkage 60 comprises a pair of interconnected links (61, 62) each having a decorative element (beads). In the first illustrated embodiment, the bead has a wire through its center axis, wherein eyelets are formed from the wire on either end, adjacent the bead. The eyelets can be oriented to be parallel, perpendicular, or anywhere in-between to one another and the bead. While the first embodiment shows the presence of a bead, other embodiments may or may not have such a decorative element.

FIGS. 1 through 7 illustrate one possible configuration for the first and second linkages (50, 60). Other configurations and designs are not shown, including designs commonly seen in the jewelry industry, namely, straight wire connections, the inclusion of additional decorative elements, additional links, etc. Rather than the twisted wire show in the Figures, the first and second linkages (50, 60) could comprise rope, string, twine, straight wire, chain, and/or other such suitable materials.

The first and second linkages (50, 60) connect to a charm 70. The term "charm" used generally to refer to a decorative element (e.g., a charm, a piece of bone, a stone, a gemstone, a piece of jewelry, a crystal, a vial, a chain, or other "decorative" elements). Preferably, this connection is through the use of one or more connecting rings (80, 82).

FIGS. 1 through 7 illustrate a pair of connecting rings (80, 82) interconnecting the charm to the first linkage 50 and the second linkage 60. While the Figures show such an orientation, it is expressly envisioned that the first and second linkages (50, 60) could directly connect to the charm, or that one (or more than two) connecting rings could be present. Likewise, one or more of the first and second linkages could comprise one or more smaller linkages connected together to form a single linkage.

The charm 70 comprises a suitable decorative element able to be connected to the first and second linkages (50, 60). The charm 70 preferably selected by the wearer to represent a person, place, thing or object the wearer wishes to be reminded of. The charm 70 could be a decorative element comprising a stone, a crystal, a vial, or other materials. The charm 70 is preferably interchangeable with another charm, allowing the wearer to select what they wish to be reminded of or a pleasing decorative element. The charm 70 may comprise an electronic device able to be wirelessly connected to a second electronic device. The electronic device may include a light that is configured to light up when a cell phone rings. The electronic device may sense when the second electronic device is no longer within a certain range of the electronic device and provide notification (e.g., a light lighting up, a sound, a vibration) to the wearer. For instance, the electronic device could alert a mother if her child (wearing the second electronic device) is no longer within a certain range.

Figure 8:
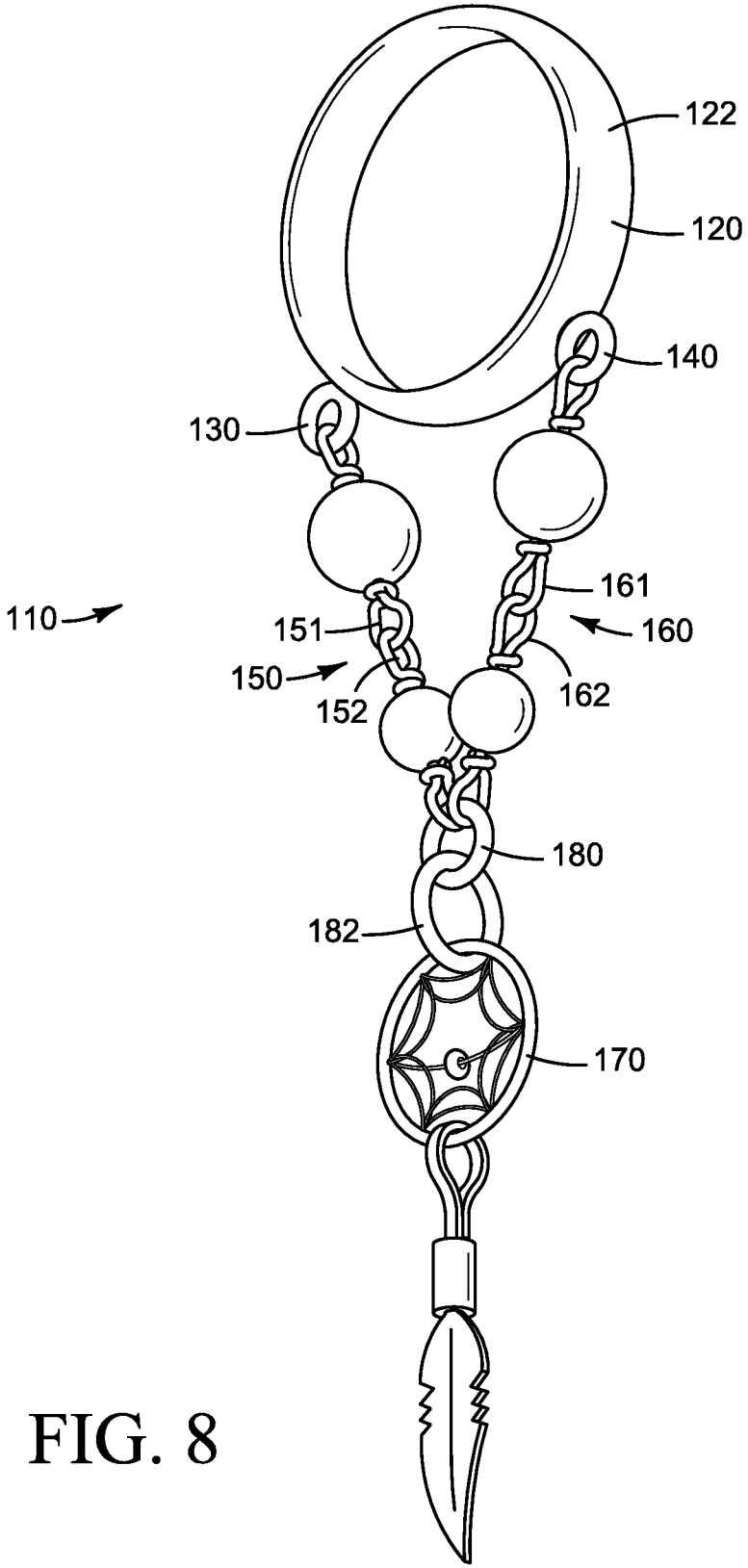
FIG. 8 is a perspective view a second embodiment of the inventive concept(s).
Figure 15:
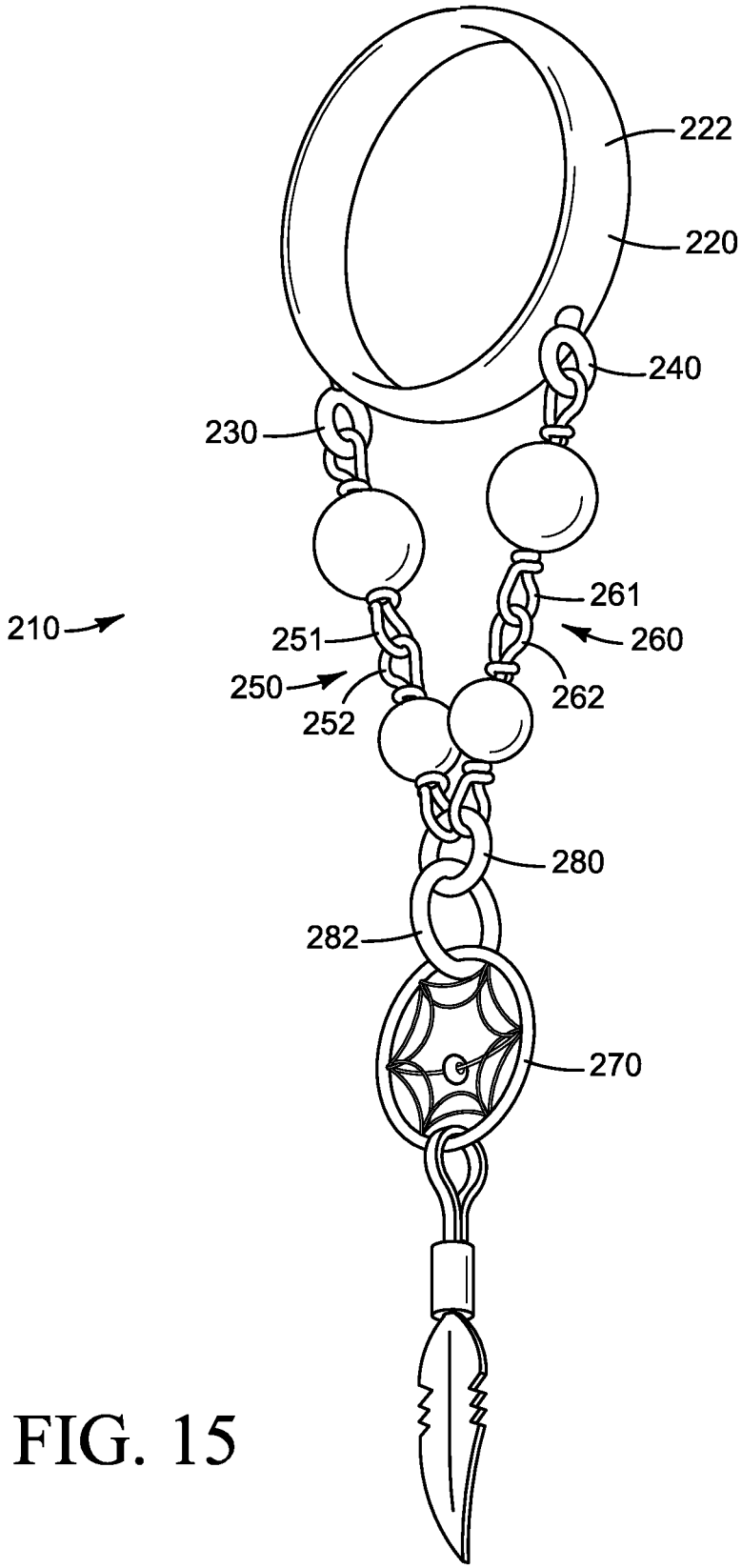
FIG. 15 is a perspective view of a third embodiment of the inventive concept(s).
Figures 16, 17, 18, 19, 20, 21:
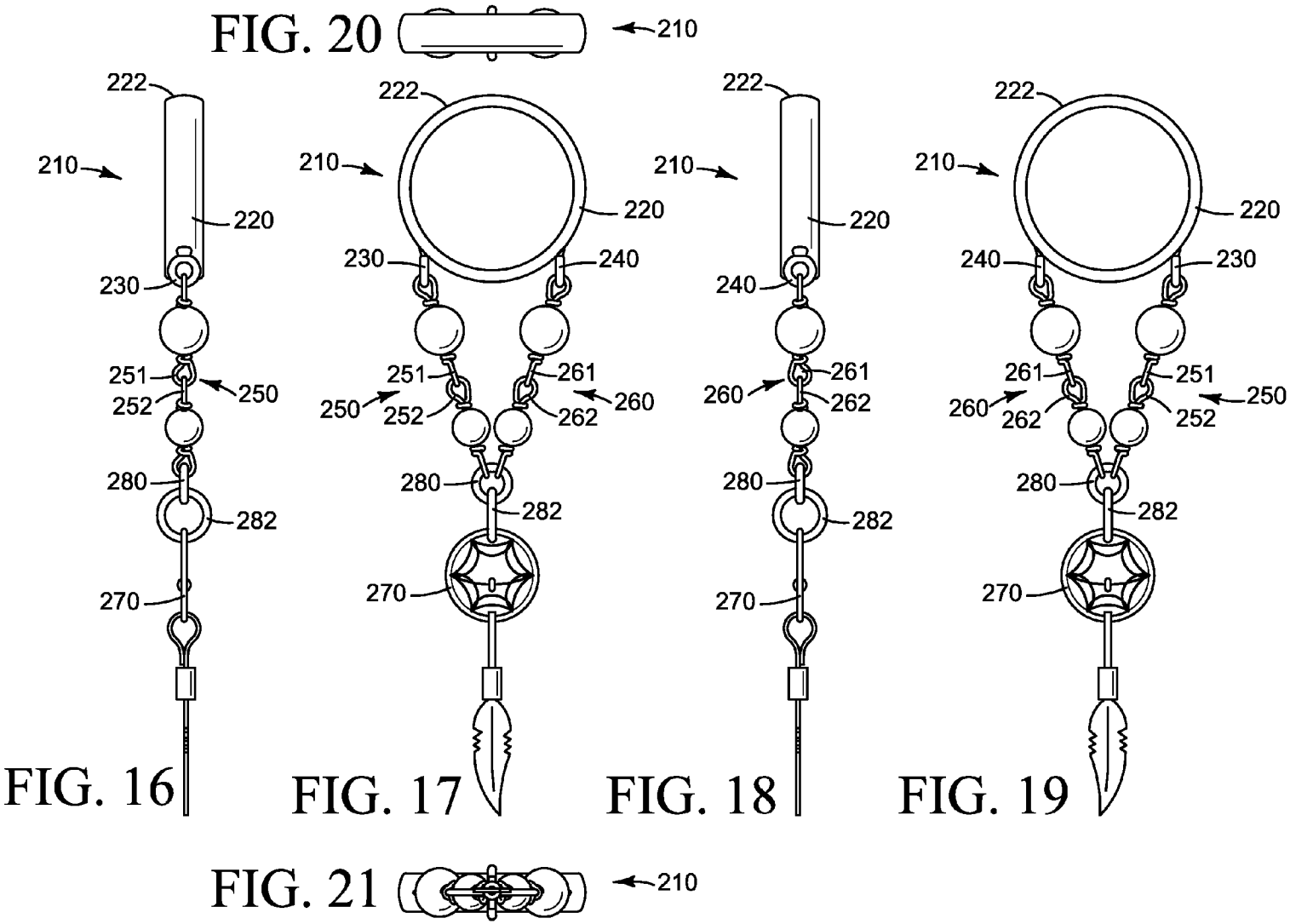
FIG. 16 is a first side view of the embodiment of FIG. 15.
FIG. 17 is a front side view of the embodiment of FIG. 15.
FIG. 18 is a second side view of the embodiment of FIG. 15.
FIG. 19 is a rear side view of the embodiment of FIG. 15.
FIG. 20 is a top side view of the embodiment of FIG. 15.
FIG. 21 is a bottom side view of the embodiment of FIG. 15.

Referring now to FIGS. 8 through 14, a second embodiment of the inventive concept(s) is illustrated. FIG. 8 illustrates a jewelry piece 110 comprising a ring shank 120, a first connector 130, a second connector 140, a first linkage 150, a second linkage 160, and a charm 170.

The first connector 130 and the second connector 140 are oriented on the outer surface 122 of the ring shank 120 in a plane generally parallel to the ring plane, particularly as shown in FIGS. 9 through 12.

Attached to the first connector 130 is a first linkage 150. In the second embodiment, the first linkage 150 comprises a pair of interconnected links (151, 152), each interconnected link (151, 152) having a small bead or other decorative element. Likewise, the second linkage 160 comprises a pair of interconnected links (161, 162) each having a decorative element. Illustrated in FIGS. 8 through 14 is one possible configuration for the first and second linkages (150, 160). Other configurations and designs are not shown, including designs commonly seen in the jewelry industry, namely, straight wire connections, the inclusion of additional decorative elements, additional links, etc. Rather than the twisted wire show in the Figures, the first and second linkages (150, 160) could comprise rope, string, twine, straight wire, chain, and/or other such suitable materials.

The first and second linkages (150, 160) connect to a charm 170. Preferably, this connection is through the use of one or more connecting rings (180, 182). FIGS. 8 through 14 illustrate a pair of connecting rings (180, 182) interconnecting the charm 170 to the first linkage 150 and the second linkage 160. While the figures show such an orientation, is expressly envisioned that the first and second linkages (150, 160) could directly connect to the charm 170, or that one (or more than two) connecting rings could be present. Connecting rings could also be utilized to connect the first and second linkage to the first and second connectors.

The charm 170 comprises a suitable decorative element able to be connected to the first and second linkages (150, 160). The charm 170 is preferably selected by the wearer to represent a person, place, thing or object the wearer wishes to be reminded of. The charm 170 could be a decorative element comprising a stone, a crystal, a vial, or other materials. The charm 170 is preferably interchangeable with another charm, allowing the wearer to select what they wish to be reminded of and/or a personally desirable charm. The charm 170 may comprise an electronic device able to be wirelessly connected to a second electronic device. The electronic device may include a light that is configured to light up when a cell phone rings. The electronic device may sense when the second electronic device is no longer within a certain range of the electronic device and provide notification (e.g., a light lighting up, a sound, a vibration) to the wearer. For instance, the electronic device could alert a mother if her child (wearing the second electronic device) is no longer within a certain range.

It is preferred that the first connector 30/130/230 and the second connector 40/140/240 be spaced apart ninety degrees (90°) from one another on the outside surface of the ring shank 20/120/220. While ninety degrees (90°) is preferred, any angle from about 180 degrees (180°) to zero degrees (0°) may be used.

FIGS. 15 through 21 illustrate a third embodiment of the inventive concept(s). In FIGS. 15 through 21, the jewelry piece 210 having a first connector 230 and a second connector 240. In this embodiment, the first and second connectors (230, 240) are oriented generally parallel to one another. Also shown in FIGS. 15 through 21 are jewelry piece 210, ring shank 220, outside surface 222, first connector 230, second connector 240, first linkage 250, link 251, link 252, second linkage 260, link 261, link 262, charm 270, connecting ring 280, and connecting ring 282.

Figure 22:
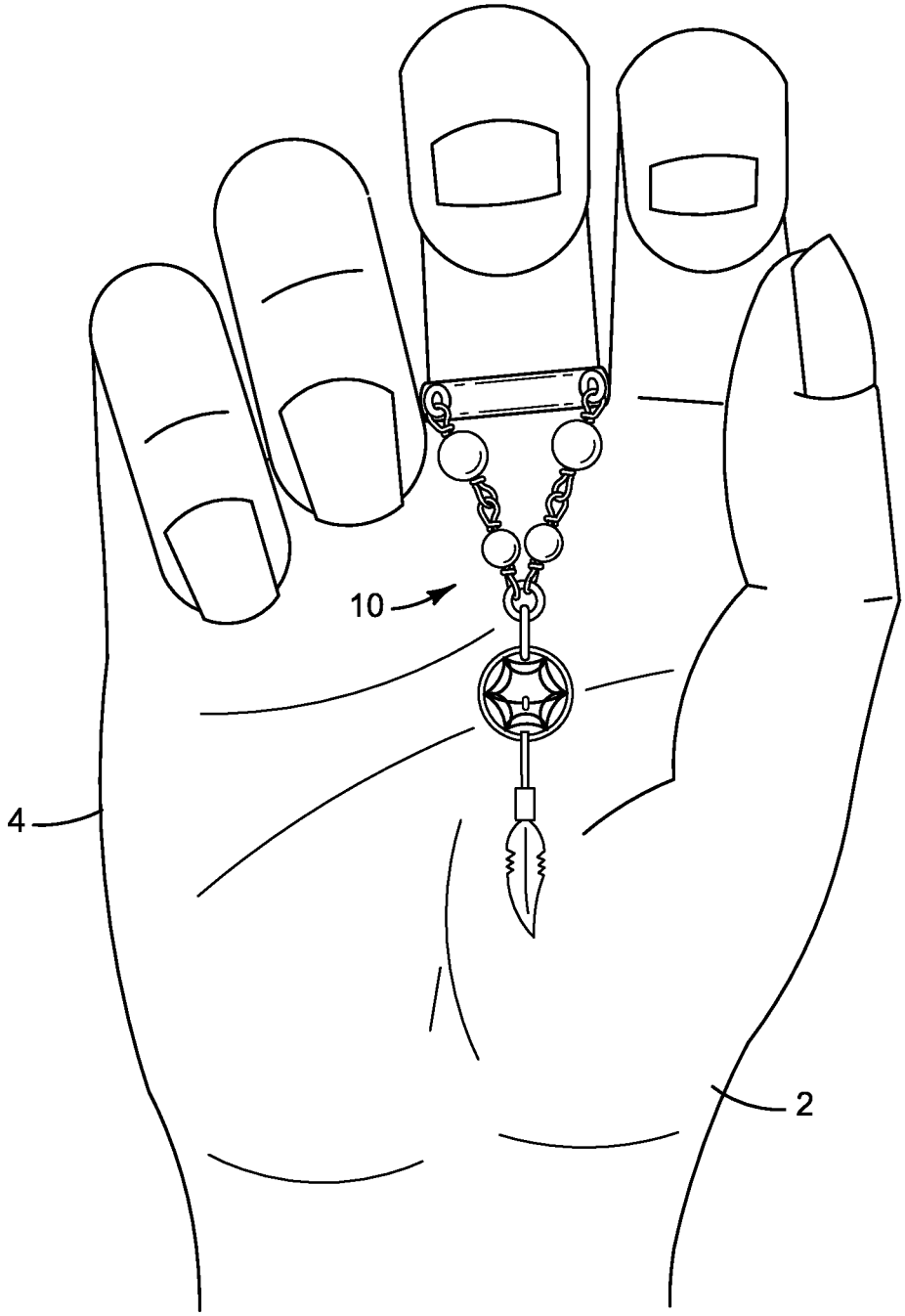
FIG. 22 is an environmental view of the embodiment of FIG. 1 shown worn by a wearer.

Referring now to FIG. 22, one preferred way the jewelry piece is to be worn by the wearer is illustrated. In such an embodiment, the ring shank is rotated upon the finger of the wearer so that the two connectors are generally adjacent the anterior side (palm side) 4 of the wearer's hand 2. In such a configuration, the first and second linkages drape along the interior side of the wearer's hand 2 enabling the charm to rest in the palm of the wearer's hand 2. The wearer then able to hold and caress the charm in her/his closed hand. Alternatively, the jewelry piece could be worn with the charm resting on the posterior side (back side) of the wearer's hand. While FIG. 22 shows the jewelry piece worn on one particular of the wearer's fingers, the jewelry piece can be worn on any finger desired by the wearer.

The jewelry piece can also be worn on a necklace, on a bracelet, as an earring, attaching to an earlobe or another wearer's body part, as part of a clothing article, on a keychain, on a belt buckle, as part of a piercing, etc.

In another embodiment of the present inventive concept(s), disclosed is a method for using the jewelry piece of either Embodiment A or Embodiment B. The method includes assisting a wearer in selecting a charm having a personal significance, or is otherwise desirable, to the wearer to attach to a ring, instructing the wearer to wear the jewelry piece on the wearer's hand so that the linkages and charm contact the anterior side of the wearer's hand (their palm), and instructing said wearer to close their hand around the linkages and the charm so that the charm is held in the wearer's hand.

Example Embodiments

Embodiment A. A jewelry piece comprising a ring, at least one first connector, at least one second connector, at least one first linkage, at least one second linkage and at least one charm, wherein: said ring having a circumference, said circumference defining an outer surface; said at least one first connector fixed on said outer surface; said at least one second connector fixed on said outer surface; said at least one first linkage interconnecting said at least one first connector and said at least one charm; and said at least one second linkage interconnecting said at least one second connector and said at least one charm. Preferably, the at least one second connector is spaced on said outer surface between about 180 degrees and zero degrees from said at least one first connector, more preferably, generally 90 degrees. Preferably, at least one first connector is oriented in a first plane, and said at least one second connector is oriented in a second plane, wherein said first and second planes intersect one another. Preferably, the charm comprises at least one connecting ring to which said linkages connect.

Embodiment B. A method of using the jewelry piece of Embodiment A, said method comprising the steps of: assisting a user in selecting a charm having a personal significance to said user from a plurality of charms, said charm for attaching to said jewelry piece of Embodiment A; instructing said user to wear said jewelry piece on said user's hand so that said linkages and charm contact the anterior side of said user's hand; and instructing said user to close said user's hand around said linkages and charm so that said charm is held in said user's hand.

Embodiment C. A jewelry piece comprising a ring, at least one first connector, at least one second connector, at least one first linkage, at least one second linkage and at least one charm, wherein: said ring having a circumference, said circumference defining an outer surface; said at least one first connector fixed on said outer surface; said at least one second connector fixed on said outer surface; said at least one first linkage interconnecting said at least one first connector and said at least one charm; and said at least one second linkage interconnecting said at least one second connector and said at least one charm. Preferably, the at least one second connector is spaced on said outer surface between about 180 degrees and zero degrees from said at least one first connector, more preferably, generally 90 degrees. Preferably, the at least one first connector is oriented in a first plane, and said at least one second connector is oriented in a second plane, wherein said first and second planes are generally parallel. Preferably, the charm comprises at least one connecting ring to which said linkages connect.

Embodiment D. A method of using the jewelry piece of Embodiment C, said method comprising the steps of: assisting a user in selecting a charm having a personal significance to said user from a plurality of charms, said charm for attaching to said jewelry piece of Embodiment A; instructing said user to wear said jewelry piece on said user's hand so that said linkages and charm contact the anterior side of said user's hand; and instructing said user to close said user's hand around said linkages and charm so that said charm is held in said user's hand.

Embodiment E. A jewelry piece comprising a ring, a first connector, a second connector, a first linkage, a second linkage and a charm, wherein: said ring having a circumference, said circumference defining an outer surface; said first connector fixed on said outer surface; said second connector fixed on said outer surface, wherein said second connector is spaced generally 90 degrees on said outer surface from said first connector; said at least one first linkage interconnecting said at least one first connector and said at least one charm; and said at least one second linkage interconnecting said at least one second connector and said at least one charm. Preferably, said first connector is oriented in a first plane, and said second connector is oriented in a second plane, wherein said first and second planes are generally parallel. Preferably, said first connector is oriented in a first plane, and said second connector is oriented in a second plane, wherein said first and second planes intersect one another. Preferably, the charm comprises at least one connecting ring to which said linkages connect.

While certain exemplary embodiments are shown in the Figures and described in this disclosure, it is to be distinctly understood that the presently disclosed inventive concept(s) is not limited thereto, but may be variously embodied to practice within the scope of the following claims. From the foregoing description, it will be apparent that various changes may be made without departing from the spirit and scope of the disclosure as defined by the following claims.

What is claimed is:

1. A finger ring comprising a ring shank for wearing on a wearer's finger, at least one first connector, at least one second connector, at least one first linkage, at least one second linkage and at least one charm, said ring shank having a circumference, said circumference defining an outer surface, wherein said outer surface has a radially outward surface, said at least one first connector fixed on said outer surface, said at least one first connector extends from said radially outward surface, said at least one second connector fixed on said outer surface, said at least one second connector extends from said radially outward surface, said at least one first linkage interconnecting said at least one first connector and said at least one charm, and said at least one second linkage interconnecting said at least one second connector and said at least one charm.

2. The finger ring of claim 1, wherein said at least one second connector is spaced on said radially outward surface between about 180degrees and zero degrees from said at least one first connector.

3. The finger ring of claim 2, wherein said at least one second connector is spaced generally 90 degrees on said radially outward surface from said at least one first connector.

4. The finger ring of claim 1, wherein said at least one first connector and said at least one second connector are oriented in a first plane, and said ring shank is oriented in a second plane, wherein said first and second planes are generally parallel.

5. The finger ring of claim 1, wherein said at least one first connector and said at least one second connector are oriented in a first plane, and said ring shank is oriented in a second plane, wherein said first and second planes intersect one another.

6. The finger ring of claim 1, wherein said at least one charm comprises at least one connecting ring to which said at least one first linkage and said at least one second linkage connect.

7. The finger ring of claim 1, wherein said at least one second connector is spaced on said radially outward surface between about 180degrees and zero degrees from said at least one first connector; and wherein said at least one first connector and said at least one second connector are oriented in a first plane, and said ring shank is oriented in a second plane, wherein said first and second planes are generally parallel.

8. A finger ring comprising a ring shank, a first connector, a second connector, a first linkage, a second linkage, and at least one charm, said ring shank having a circumference, said circumference defining radially outward surface, said first connector fixed on and radially extending from said radially outward surface, and said second connector fixed on and radially extending from said radially outward surface, wherein said second connector is spaced on said radially outward surface between about 180 degrees and zero degrees from said first connector.

9. The finger ring of claim 8, wherein said second connector is spaced generally 90 degrees on said radially outward surface from said first connector.

10. The finger ring of claim 8, wherein said first connector and said second connector are oriented in a first plane, and said ring shank is oriented in a second plane, wherein said first and second planes are generally parallel.

11. The finger ring of claim 8, wherein said first connector and said second connector are oriented in a first plane, and said ring shank is oriented in a second plane, wherein said first and second planes intersect one another.

12. The finger ring of claim 8, wherein said at least one charm comprises a connecting ring to which said first and second linkages connect.

13. The finger ring of claim 8, wherein said first linkage interconnects said first connector and said at least one charm, and said second linkage interconnects said second connector and said at least one charm.

14. A method of using the finger ring of claim 8, said method comprising the steps of:

a wearer selecting said at least one charm from a plurality of charms, said at least one charm for attaching to said finger ring of claim 8;

said wearer wearing said finger ring on said wearer's hand so that said first and second linkages and at least one charm contact the anterior side of said wearer's hand; and said wearer closing said wearer's hand around said first and second linkages and said at least one charm so that said at least one charm is held in said wearer's hand.

15. A method of using the finger ring of claim 10, said method comprising the steps of:

a wearer selecting said at least one charm from a plurality of charms, said at least one charm for attaching to said finger ring of claim 10;

said wearer wearing said finger ring on said wearer's hand so that said first and second linkages and at least one charm contact the anterior side of said wearer's hand; and said wearer closing said wearer's hand around said first and second linkages and said at least one charm so that said charm is held in said wearer's hand.

16. A method of using the finger ring of claim 11, said method comprising the steps of:

a wearer selecting a charm having a personal significance to said wearer from a plurality of charms, said charm for attaching to said finger ring of claim 11, said wearer wearing said finger ring on said wearer's hand so that said linkages and charm contact the anterior side of said wearer's hand; and said wearer closing said wearer's hand around said linkages and charm so that said charm is held in said wearer's hand.

17. A finger ring comprising a ring shank, a first connector, a second connector, a first linkage, a second linkage and a charm, wherein:

said ring shank having a circumference, said circumference defining a radially outward surface;

said first connector fixed on and radially extending from said radially outward surface;

said second connector fixed on and radially extending from said radially outward surface, wherein said second connector is spaced generally 90 degrees on said radially outward surface from said first connector;

said at least one first linkage innerconnecting said at least one first connector and said at least one charm; and said at least one second linkage innerconnecting said at least one second connector and said at least one charm.

18. The finger ring of claim 17, wherein said first connector and said second connector are oriented in a first plane, and said ring shank is oriented in a second plane, wherein said first and second planes are generally parallel.

19. The finger ring of claim 17, wherein said first connector and said second connector are oriented in a first plane, and said ring shank is oriented in a second plane, wherein said first and second planes intersect one another.

20. The finger ring of claim 17, wherein said charm comprises at least one connecting ring to which said first and second linkages connect.

* * * * *